US007682156B2

(12) United States Patent
Dung

(10) Patent No.: US 7,682,156 B2
(45) Date of Patent: Mar. 23, 2010

(54) CONTACT BLOCK AT THE END OF AN ELECTRODE SUPPORT FOR FORMING A COMPONENT OF AN ELECTRIC OVEN

(76) Inventor: Arndt Dung, Heuland 54, 58093 Hagen (DE)

( * ) Notice: Subject to any disclaimer, the term of this patent is extended or adjusted under 35 U.S.C. 154(b) by 905 days.

(21) Appl. No.: 10/582,723

(22) PCT Filed: Jan. 26, 2005

(86) PCT No.: PCT/EP2005/000732

§ 371 (c)(1),
(2), (4) Date: Jun. 13, 2006

(87) PCT Pub. No.: WO2005/074324

PCT Pub. Date: Aug. 11, 2005

(65) Prior Publication Data

US 2009/0247022 A1 Oct. 1, 2009

(30) Foreign Application Priority Data

Jan. 30, 2004 (DE) ..... 10 2004 005 051

(51) Int. Cl.
*H01R 39/00* (2006.01)

(52) U.S. Cl. ..... 439/11

(58) Field of Classification Search ..... 439/11, 439/830; 373/101, 99; 314/130; 219/125.1; 29/890.03

See application file for complete search history.

(56) References Cited

U.S. PATENT DOCUMENTS

| | | | | | |
|---|---|---|---|---|---|
| 2,086,148 | A | * | 7/1937 | Young | 313/238 |
| 3,804,966 | A | * | 4/1974 | Winter et al. | 373/101 |
| 4,110,548 | A | * | 8/1978 | Dresch et al. | 373/99 |
| 4,323,717 | A | * | 4/1982 | Garner et al. | 373/101 |
| 4,531,219 | A | * | 7/1985 | Zollner et al. | 373/101 |
| 4,674,817 | A | * | 6/1987 | Olms | 439/592 |
| 4,700,356 | A | * | 10/1987 | Friedrich et al. | 373/101 |
| 5,200,974 | A | * | 4/1993 | Kark et al. | 373/94 |

* cited by examiner

*Primary Examiner*—Alexander Gilman
(74) *Attorney, Agent, or Firm*—Louis Ventre, Jr.

(57) ABSTRACT

The aim of the invention is the reduction of the impairment in current transfer from the contact plate (112), forming part of the electrode support arm (11), to the contact block (12), interacting with the electrode, caused by deposits between the contact plate (112) and the contact block (12) due to erosion during the fusion operation. Said aim is achieved, whereby the contact block (12) which may be brought into planar contact against a partial region of the electrode (21), is provided with a medial passage (124), running to the support arm (11), for removal of at least the large part of the erosion, said passage having a continuation (111) in the support arm (11).

9 Claims, 2 Drawing Sheets

Figure 1:
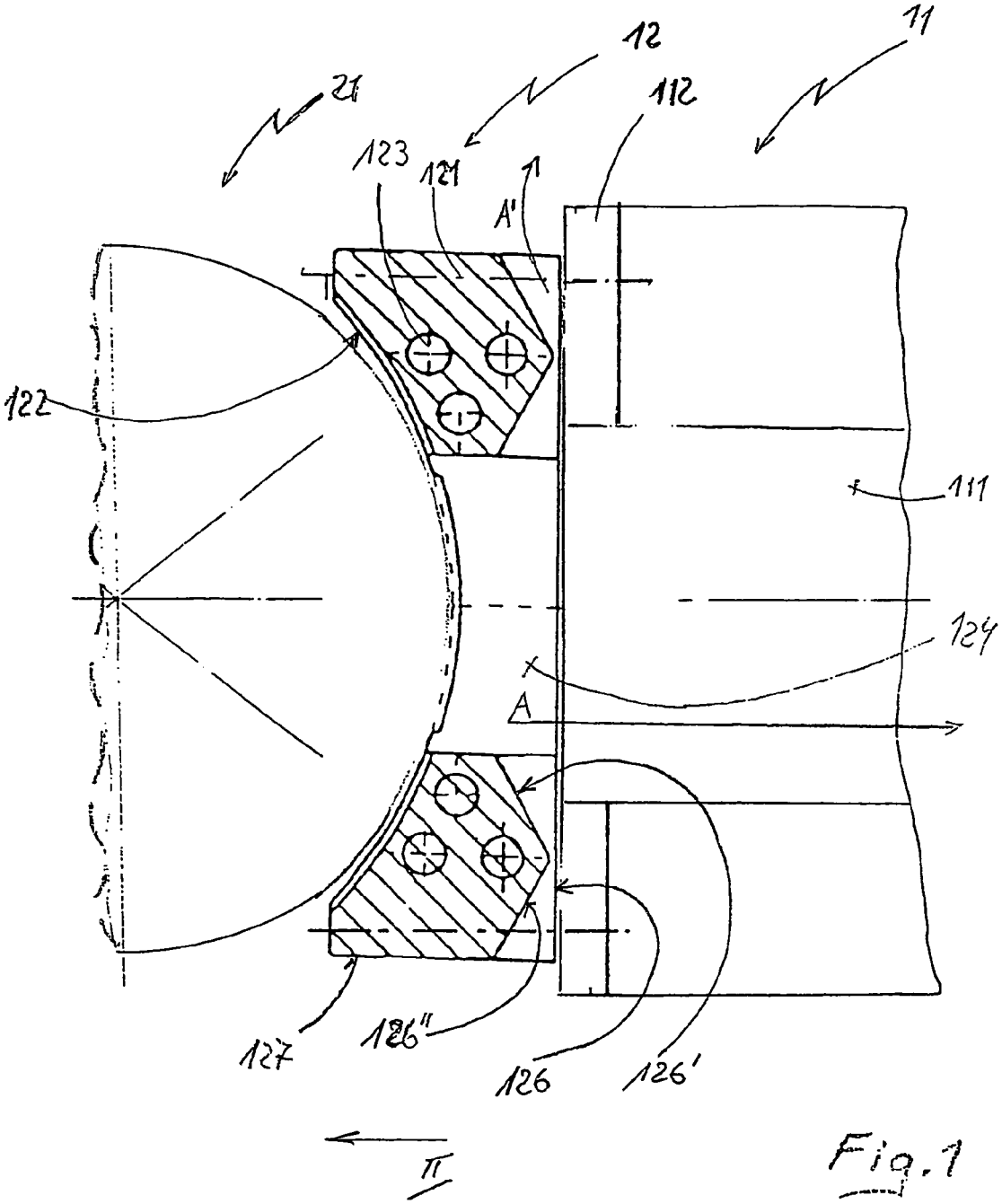

CONTACT BLOCK AT THE END OF AN ELECTRODE SUPPORT FOR FORMING A COMPONENT OF AN ELECTRIC OVEN

The invention relate to a contact jaw, which is to be assigned exchangeably to the contact plate at the free end of an electrode-carrying arm forming a component of an electrode furnace for the exchangeable electrode, which can be brought into abutment so as to make electrical contact with the electrode-carrying arm by means of a clip guided at the electrode-carrying arm.

While the smelting operation is taking place, deposits are formed between the contact plate forming the component of the electrode-carrying arm and the contact jaw detachably attached thereto due to the evaporation during melting carried along by the rising gases. These deposits lead to a progressive impairment of the passage of current from the contact plate to the contact jaw. The effect is then also intensified further owing to the fact that a snug seat of the contact jaw at the contact plate cannot be brought about by screw connections detachably combining the contact jaw with the contact plate. This results in the possibility of a limited displacement of the contact jaw with respect to the contact plate during the operation of the furnace, which leads not to the removal of deposits between the contact jaw and the contact plate, but to intensified depositions due to electrode wear debris with the consequence of progressive impairment of the passage of current from the contact plate to the contact jaw.

With this as background, it is an object of the invention to develop a solution, which, based on a contact jaw, which, on the one hand, is in contact over a large area with the contact plate forming a component of the electrode-carrying arm and, on the other, over a large area with the electrode interacting with the contact plate, eliminates or, at least alleviates the impairment of the passage of current from the contact plate to the contact jaw, which is placed in contact with the contact plate and enters into interaction with the contact jaw.

This objective is accomplished with a contact jaw, which is exchangeably disposed at the free end of an electrode-carrying arm forming a component of an electric furnace for the exchangeable electrode, which can be brought into abutment so as to make electrical contact by means of a clip guided at the electrode-carrying arm, which is characterized in that The contact jaw, which can be brought into 2-dimensional contact with a partial region of the electrode, is provided centrally with a passage, which extends to the carrying arm, in which it is continued.

Refinements of the invention arise out of the dependent claims 2 to 9.

Material, which volatilizes during the melting while the furnace is being operated, is discharged continuously through the passage formed in the contact jaw and extending to the carrying arm. There no longer is a noticeable effect on the passage of current from the contact plate forming the component of the electrode-carrying arm to the contact jaw interacting with the electrode.

Counteracting the relative movements between the contact jaw, which is combined detachably by screw connections with the contact plate during the relative movements resulting between the contact jaw and the contact plate, which previously had to be put up with, contributes to the prevention or at least the limitation of the formation of deposits between contact plate and contact jaw attributed to electrode attrition. This can be realized in a development of the invention in that the contact jaw is provided at the back on both sides with recesses, which extend preferably in the vertical direction and accommodate springs, the overhangs of which fit into corresponding recesses in the contact plate, filling them.

Figure 2:
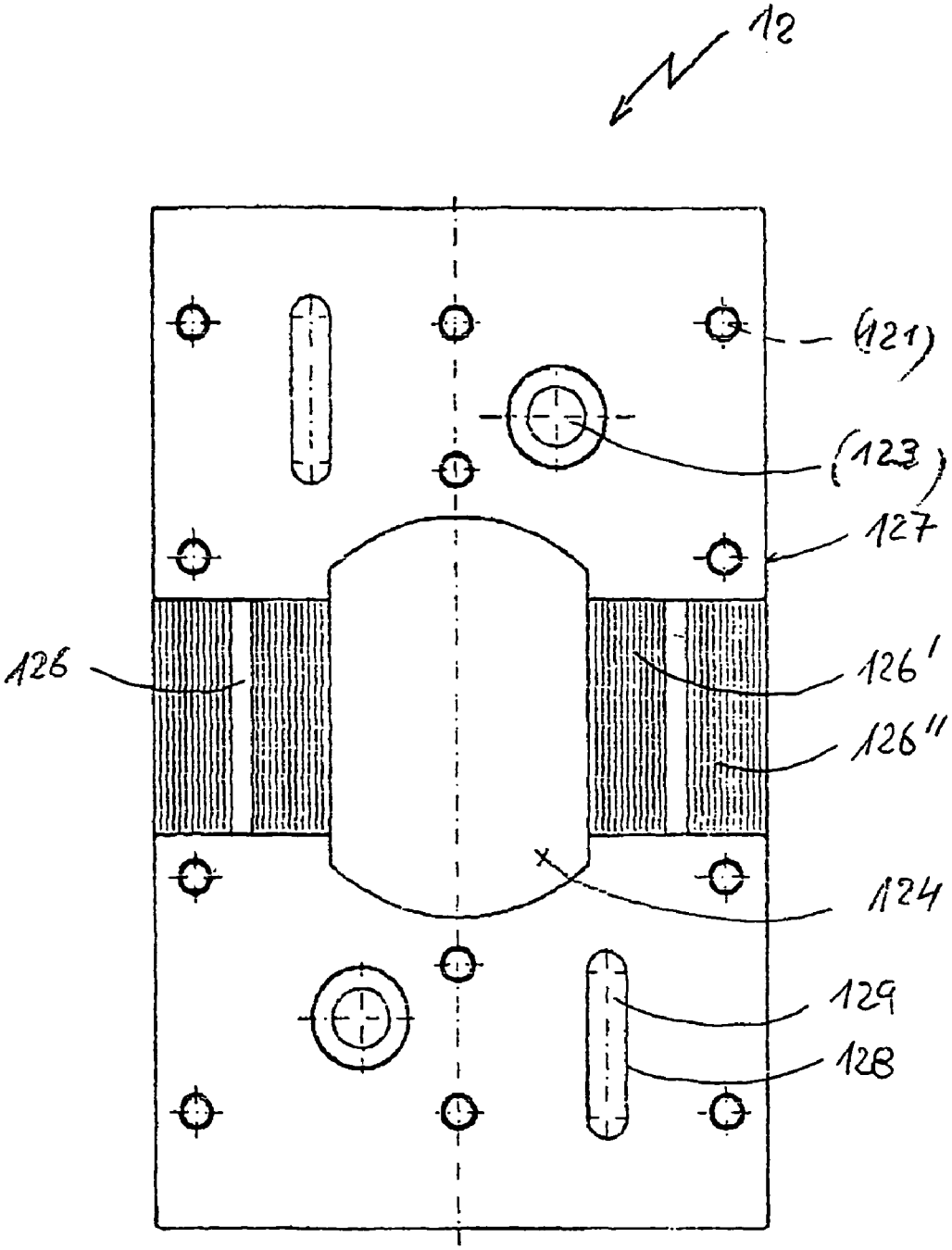

The invention is explained further in examples, which are reproduced quite diagrammatically in the drawing, in which FIG. 1 shows a truncated, horizontal section through the ensemble in the region, in which the electrode is clamped and FIG. 2 shows a view of the contact jaw forming the component of the ensemble from its carrying arm-side contact side (arrow II in Figured 1).

In the representation, the end face region of the electrode-carrying arm is labeled 11. The electrode-carrying arm consists of a box profile, which is open in the center (111). The contact jaw 12 is attached in front of the head of the electrode-carrying arm 11 and, moreover, by the screw connections 121 between the contact jaw 12 and the contact plate 112 forming the component of the electrode-carrying arm. The exchangeable electrode 21 is brought into electrical contact with the contact jaw 12 over a clip, which is not shown and is guided at the carrying arm 11. The contact-giving surfaces of the contact jaw 12 are labeled 122. The cooling channels, passing through the contact jaw 12, are labeled 123. The contact jaw 12 is open in the center (124) to the passage 111 formed in the carrying arm 11.

For the purpose of avoiding melting-induced evaporation occurring between the contacting surfaces 124 of the contact jaw 12 and the carrying-arm contacts, a taper of the vertical contacting surfaces 126 of the contact jaw 12 with respect to the carrying arm contacts 112 is provided pursuant to the invention in the region of the passage 124 in the contact jaw 12. In the example shown, the taper, on the one hand, is inclined (126') to the passage 124 and, on the other, slopes downward (126") to the periphery 127 of the contact jaw. A taper, inclined from the periphery of the contact jaw to the passage in the contact jaw, would be an alternative.

Due to these tapers, there no longer are impairing deposits between the contact jaw and the carrier-arm contacts, since any evaporation occurring during the melting is discharged completely through the carrying arm (arrow A in FIG. 1), optionally then also to the outside (arrow A' in FIG. 1). The suction developing in the contact jaw passage and continuing in the carrying arm passage during the smelting operation contributes to this.

In a refinement, in addition to the screw connection 121 between the contact jaw 12 and the electrode-carrying arm 11, a groove-spring connection may be provided, which prevents relative movements between the contact jaw 12 and the carrying arm 11, that is, of the contact plate 112 of the latter. This possibility is indicated in FIG. 2. According to this, grooves 128 are formed in the contact jaw 12 in the contacting surface on the carrying arm side. Springs 129, the overhang of which, when the contact jaw 12 is attached to the carrying arm 11, are inserted in corresponding grooves formed in the contact plates 112 located in front of the head of the carrying arm 11, are inserted in the grooves 128.

The invention claimed is:

1. Contact jaw, which is to be assigned exchangeably to the contact plate at the free end of an electrode-carrying arm forming a component of an electrode furnace for the exchangeable electrode, which can be brought into abutment so as to make electrical contact with the electrode-carrying arm by means of a clip guided at the electrode-carrying arm, characterized in that the contact jaw, which can be brought into abutment two-dimensionally with a partial region of the electrode, is provided centrally with a passage, which extends to the carrying arm and is continued in the carrying arm.

2. The contact a jaw of claim 1, characterized by a concave course of the horizontal surfaces of the contact jaw forming the boundary of the passage passing through the contact jaw.

3. The contact jaw of claims 1 characterized in that the passage, passing through the contact jaw, is provided with tapers inclined from the back of the contact jaw to the passage.

4. The contacting jaw of claim 3, characterized in that the tapers, inclined towards the inside, start out at a distance from the outer edge of the contact jaw and the remaining regions with outwardly inclined tapers.

5. The contact jaw of claim 3, characterized in that the tapers, starting out from the outer edges of the contact jaw, incline to the passage.

6. The contact jaw of one of the claims 1 characterized in that the contact jaw is provided with recesses on both sides at the back, the recesses accommodating springs, the overhangs of which are inserted into corresponding recesses located in the contact plate forming a component of the electrode-carrying arm, these recesses being filled by the springs.

7. The contact jaw of claim 6, characterized in that the recesses extend in the vertical direction.

8. The contact jaw of claims 6 characterized by springs inserted with a snug fit into the recesses.

9. The contact jaw of one of the claims 1 characterized in that the boreholes for the screw connection of the contact jaw to the carrying arm pass through the contact jaw in lateral overhangs of the contact jaw over the contact surface.

* * * * *